US008490826B2

(12) United States Patent
Schütz

(10) Patent No.: US 8,490,826 B2
(45) Date of Patent: Jul. 23, 2013

(54) TRANSPORT AND STORAGE CONTAINERS FOR LIQUIDS

(75) Inventor: Udo Schütz, Selters/Westerwald (DE)

(73) Assignee: Protechna S.A., Fribourg (CH)

( * ) Notice: Subject to any disclaimer, the term of this patent is extended or adjusted under 35 U.S.C. 154(b) by 646 days.

(21) Appl. No.: 11/506,599

(22) Filed: Aug. 18, 2006

(65) Prior Publication Data

US 2007/0039955 A1 Feb. 22, 2007

(30) Foreign Application Priority Data

Aug. 20, 2005 (DE) ..... 10 2005 039 409
Jul. 11, 2006 (DE) ..... 10 2006 031 940

(51) Int. Cl.
*B65D 6/34* (2006.01)

(52) U.S. Cl.
USPC ..... 220/647; 220/23.91; 206/386

(58) Field of Classification Search
USPC ..... 220/23.91, 485, 647, 23.87, 668, 220/495, 678, 23.9, 646; 206/386, 600
See application file for complete search history.

(56) References Cited

U.S. PATENT DOCUMENTS 4,909,387 A 3/1990 Schutz
5,408,735 A * 4/1995 Schleicher ..... 29/432.2
5,499,438 A 3/1996 Schutz
5,645,185 A * 7/1997 Cassina ..... 220/1.5
2002/0008108 A1* 1/2002 Van Giezen et al. ..... 220/23.91
2004/0164082 A1 8/2004 Schutz
2005/0161965 A1* 7/2005 Eberlein ..... 296/29

FOREIGN PATENT DOCUMENTS

DE 4425630 A1 10/1995
DE 4425630 C2 9/1996
EP 0633200 A1 1/1995

* cited by examiner

*Primary Examiner* — Jeffrey Allen

(74) *Attorney, Agent, or Firm* — Lucas & Mercanti, LLP; Klaus P. Stoffel

(57) ABSTRACT

A transport and storage container for liquids has as principal components a palette-like bottom frame for an exchangeable inner container of synthetic material and a grate casing with horizontal and vertical grate rods of metal for receiving the inner container. The vertical grate rods connected with their upper ends to the upper border profile of the grate casing by dot welding and clinching. As a result of the two-fold connection by positive and frictional engagement of the vertical grate rods to the upper circumferential border profile of the grate casing ensures that, when the dot welded connections fail, the fastening of the vertical grate rods to the upper border profile of the grate casing is ensured by the clinch connection and, when the clinch connection fails, the fastening of the grate rods to the upper border profile of the grate casing is ensured by the dot welded connections.

3 Claims, 3 Drawing Sheets

TRANSPORT AND STORAGE CONTAINERS FOR LIQUIDS

BACKGROUND OF THE INVENTION

1. Field of the Invention

The present invention relates to a transport and storage container for liquids. The container includes a palette-like bottom frame for an exchangeable inner container of synthetic material which has four side walls, a bottom wall and an upper wall, a closable filling connection integrally formed with the upper wall and a discharge connection with a discharge fitting integrally formed at a lower portion of a side wall, and with a grate casing with horizontal and vertical grate rods of metal for receiving the inner container, wherein the ends of the vertical grate rods are welded to a lower and upper circumferential horizontal border profile.

2. Description of the Related Art

When a transport and storage container of the above described type for liquids known from DE 10 2004 058 985 A1 stacked on a lower container of a stack of containers slides during stacking or during transport, there is the danger that the upper container which has the corner and middle legs of the palette-like lower frame will slide inwardly from the upper edge profile of the grate casing constructed as a hollow profile of the lower container. This has the result that the upper area of the grate casing of the lower container is expanded under the weight of the upper container which is filled with a liquid, so that the screw connections of the cover struts extending diagonally over the upper wall of the synthetic inner container with the upper edge profile are separated and the inner container as well as the welded connections of the upper ends of the vertical grate rods with the upper edge profile of the grate casing are damaged.

In addition, there is the possibility that, due to static bending stresses because of stacking loads during stacking of several containers and bending surge loads during transportation due to surge vibrations which emanate from the liquid material in the synthetic inner container and are transmitted through the flexible casing of the inner container to the grate casing, and due to drive vibrations transmitted by the transport vehicle and an impact load, for example, due to dropping of the palette container from a certain height, the welded connections of the vertical grate rods with the upper border profile of the grate casing fail and the border profile is partially or completely separated from the vertical grate rods of the grate casing and, thus, transportation damage occurs at the containers.

SUMMARY OF THE INVENTION

Therefore, is the primary object of the present invention to provide a grate casing of the transport and storage container of the above-described type for liquids which is improved in order to achieve an increased stacking and transporting security of the container.

In accordance with the present invention, the flatly pressed upper ends of the vertical grate rods of the grate casing are connected by a frictionally and positively engaging connection to a circumferential web which is integrally formed with the upper edge profile of the grate casing by means of dot welded connections and clinch connections of the ends of the vertical grate rods with the upper border profile of the grate casing, wherein, when due to a failure of the dot welded connection of a grate rod connection at the upper border profile fails due to a static and/or dynamic force, the fastening of the grate rods is effected by the clinch connection, and, when the clinch connection of a grate rod connection at the upper border profile fails, the grate rod attachment is effected by the dot welded connections.

The multiple, particularly triple, dot welding in combination with a clinch connection of the upper and possibly the lower flatly pressed ends of the vertical grate rods to a circumferential border profile of the grate casing of the transport and storage container according to the present invention ensure an optimum stacking and transportation safety of the container which, in comparison to the static and dynamic loads, achieves a resistant and frictionally and positively engaging connection of the upper and possibly the lower ends of the vertical grate rods to the circumferential upper and lower edge profiles of the grate casing of the container.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
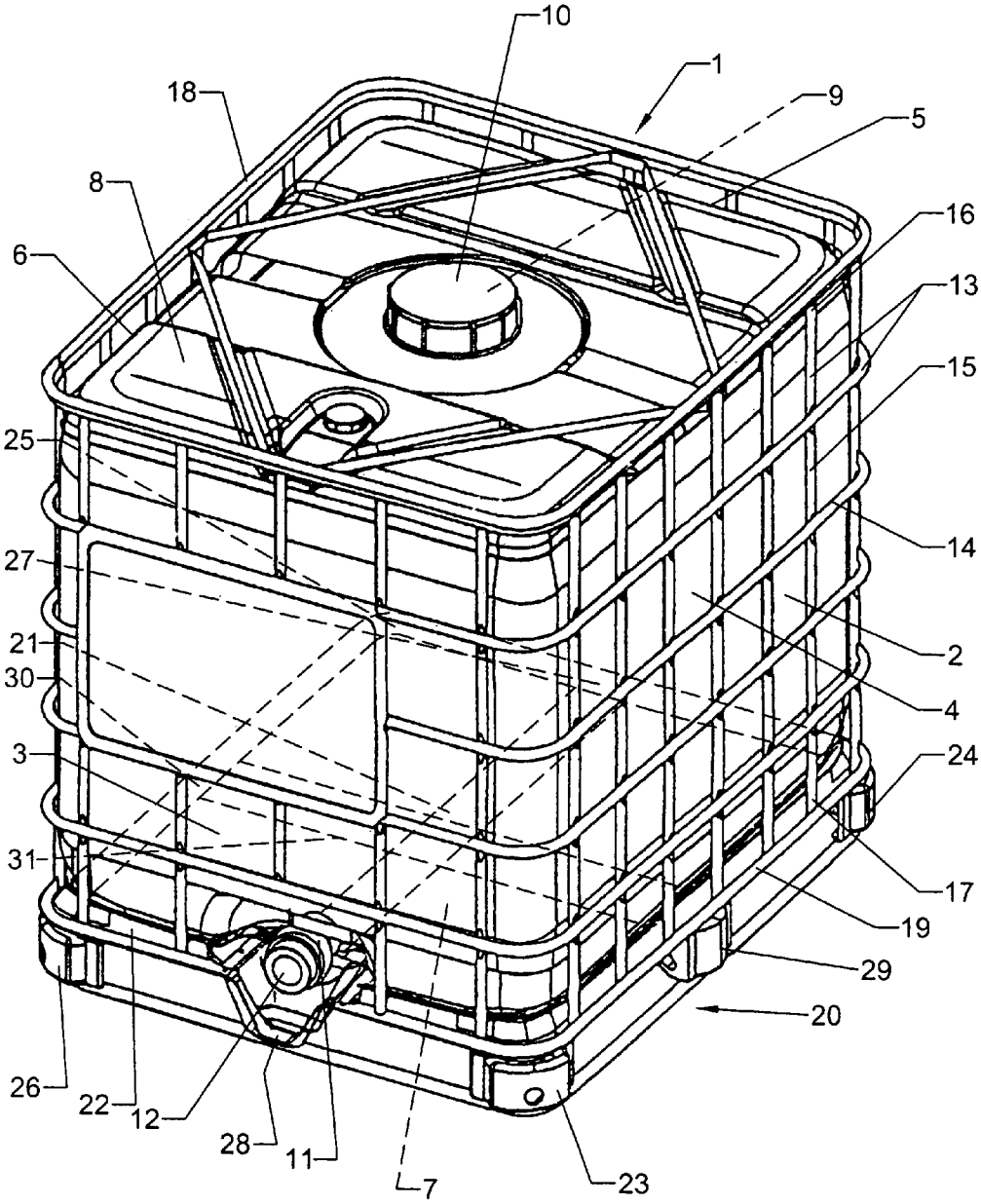
FIG. 1 is a perspective view of a transport and storage container.

The transport and storage container 1 for liquids shown in FIG. 1, which can be used as a disposable or reusable container, has as its principal components an exchangeable, parallelepiped-shaped inner container 2 of synthetic material having four side walls 3 to 6, a front wall 7 and an upper wall 8, a filling connection 9 which can be closed with a cover 10 and a discharge connection 12 integrally formed at a lower portion of the front wall 3. In addition, the container includes an outer grate casing 13 of intersecting horizontal and vertical grate rods 14, 15 of metal for receiving the inner container 2, wherein the ends 16, 17 of the vertical grate rods 15 are welded to an upper and a lower circumferential, horizontal border profile 18, 19 of the grate casing 13, respectively, and a palette-like bottom frame 20 with length and width dimensions which meet European standards.

The lower bottom 7 of the inner container 2 constructed as a discharge bottom is constructed with a central discharge groove 21 which descends from the container rear wall 5 to the discharge connection 11 in the front wall 3 of the container, and the inner container 2 is stands with the lower bottom 7 on the correspondingly constructed bottom 22 of the bottom frame 20.

The bottom 22 of the bottom frame 20 of the transport and storage container 1, which is used for handling by means of a forklift, a shelf operating system or similar transporting means, rests on four corner legs 23 to 26, a rear center leg 27, a front center leg 28 formed with the bottom 22, and the center leg 28 is arranged above the discharge fitting 12 of the transport container 1, as well as two lateral center legs 29, 30 which are formed by the outer ends of a bridge-like stiffening sheet 31 for the bottom 22.

The flatly pressed upper ends 16 of the vertical tubular grate rods 15 of the grate casing 13, which have double the material thickness of the sheet of the grate rods, are connected in a positively engaging and frictionally engaging manner with a triple dot welding 32 and a clinch connection 33*a* to a circumferential web 34 which is integrally formed with the upper tubular border profile 18 of the grate casing 13, wherein the web 34 has double the material thickness of the border profile.

Figure 2:
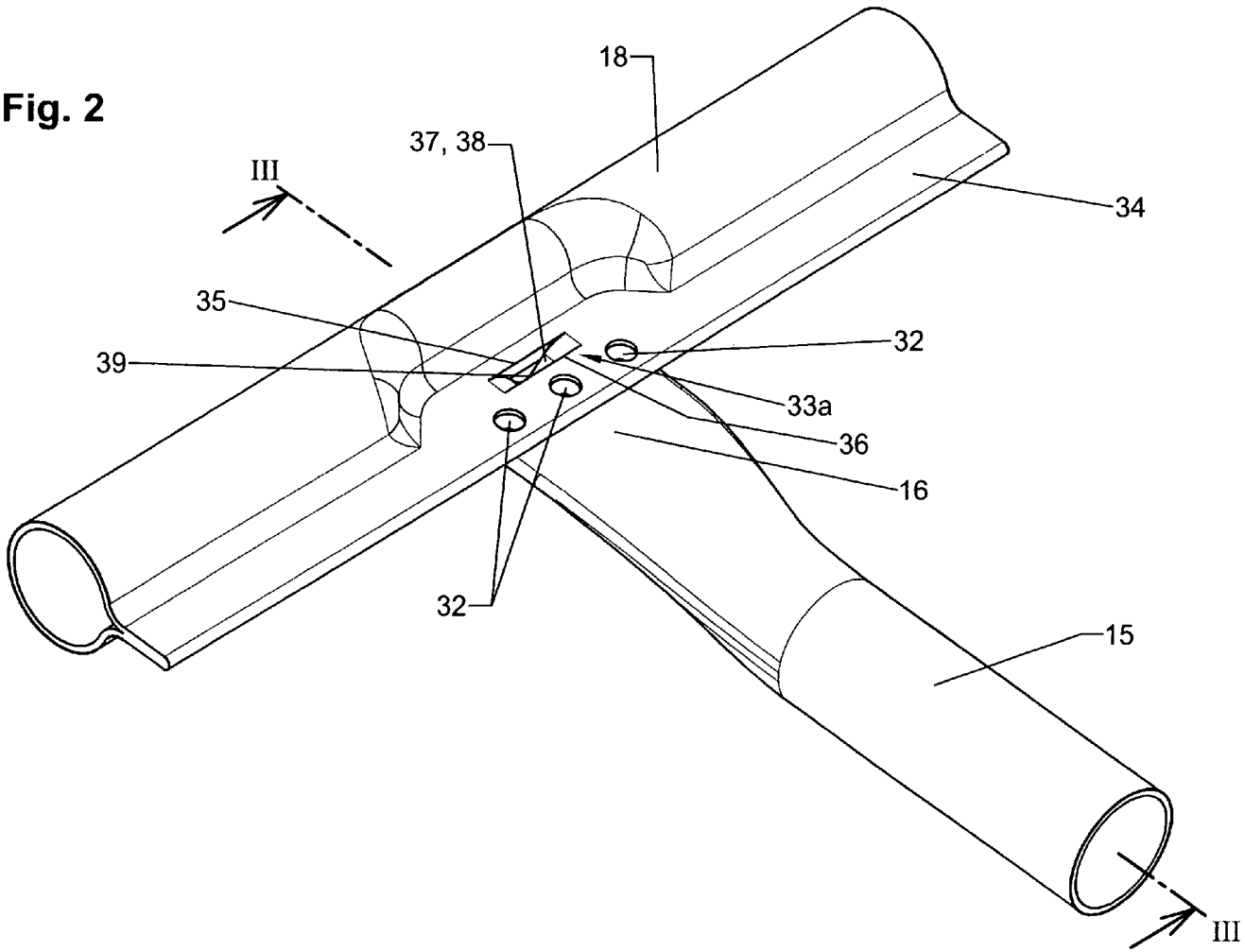
FIG. 2 is a perspective illustration, on a larger scale, of the fastening of the upper end of a vertical grate rod of the grate casing of the container of FIG. 1 to the upper edge profile of the grate casing.
Figure 3:
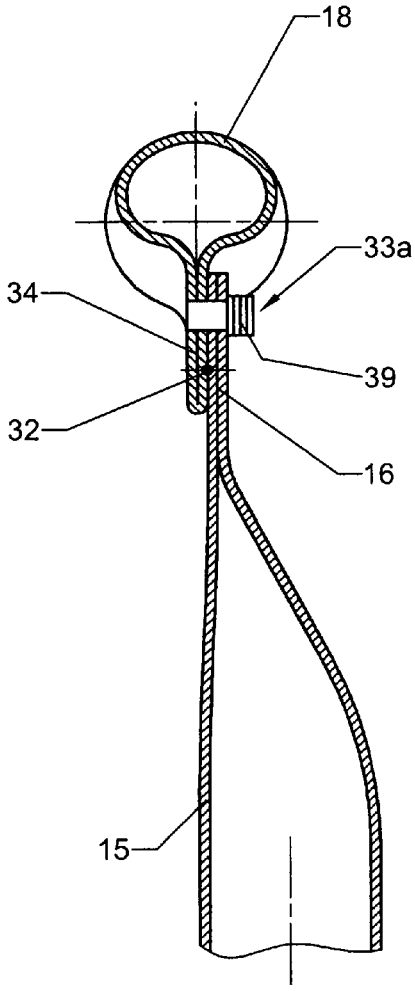
FIG. 3 is a sectional view taken along Sectional line III-III of FIG. 2 of a first embodiment of the attachment of a vertical grate rod to the edge profile.

For manufacturing the clinch connections 33*a* according to FIGS. 2 and 3, a tool consisting of top and bottom dies is used for making two parallel incisions 35, 36 each in the web 34 of the upper border profile 18 and in the flat upper end 16 of a vertical grate rod 15 which rests against the web for forming two narrow strips 37, 38 which are connected with their ends to the web 34 and the flat rod end 16, respectively, and are formed by penetration joining into a push-button like clinch element 39.

Figure 4:
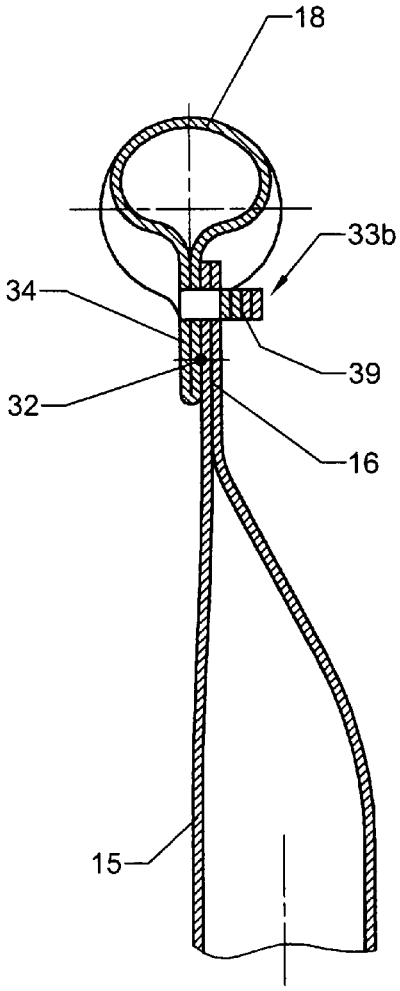
FIG. 4 is a sectional view, corresponding to FIG. 3, showing a second embodiment of the attachment of a vertical grate rod to the border profile.

Clinch element 39 formed by penetration joining of the clinch connection 33*b* in accordance with FIG. 4 for fastening the upper flatly pressed end 16 of a vertical grate rod 15 to the web 34 of the upper border profile 15 of the grate casing 13 is hump-shaped.

The local transforming process creates inseparable clinch elements which have a high holding force. Especially under dynamic loads, it has been found that such clinch elements have a significantly better support behavior than the resistance weld dots because clinch elements reach their endurance strength at higher force amplitudes.

The two-fold fastening by a frictionally engaging and positively engaging connection of the vertical grate rods with the upper circumferential border profile of the grate casing of the transport and storage container of the type described above for liquids by means of dot welding connections and a clinch connection meets the required safety function which is based on ensuring the fastening of the vertical grate rods to the upper border profile of the grate casing by means of the clinch connection if the welded connections fail, and the fastening of the grate rods to the upper border profile of the grate casing is ensured by the dot welded connections if the clinch connection fails.

Deviating from the described embodiment, the vertical grate rods 15 can also be fastened with their lower ends 17 by dot welding and clinching to the lower border profile 19 of the grate casing 13.

While specific embodiments of the invention have been shown and described in detail to illustrate the inventive principles, it will be understood that the invention may be embodied otherwise without departing from such principles.

I claim:

1. A transport and storage container for liquids, the container comprising a palette-like bottom frame for an exchangeable inner container of synthetic material having four side walls, a bottom wall and an upper wall, a closeable filling connection integrally formed with the upper wall, a discharge connection with a discharge fitting integrally formed at a lower portion of the sidewalls, and a grate casing with horizontal and vertical grate rods of metal receiving the inner container, wherein ends of the vertical grate rods are welded to lower and upper circumferential horizontal border profiles, further comprising a frictionally engaging and a positively engaging fastening of flatly closed upper ends of the vertical grate rods of the grate casing to a circumferential web integrally formed with the upper border profile of the grate casing by both dot welded connections and clinch connections, the dot welded connections and the clinch connections being formed at different connecting sites so that the dot welded connections are formed at a different location than the clinch connections, the clinch connections connecting the ends of the vertical grate rods with the upper border profile of the grate casing, wherein, two incisions are provided in the web of the border profile and in the flat upper end of a vertical grate rod of the grate casing which rests against the web for forming two narrow strips, wherein ends of the narrow strips are connected to one of the web and the flat rod end, and wherein the strips are formed by penetration or penetration joining into a clinch element, so that if the dot welded connections of a grate rod to the upper border profile fails under static and/or dynamic load applications, the grate rod connection is effected by the clinch connection, and, if the clinch connection of the grate rod to the upper border profile fails, the grate rod connection is effected by the dot welded connections.

2. The container according to claim 1, wherein flatly compressed lower ends of the vertical grate rods of the grate casing are connected to a circumferential web integrally formed to the lower border profiled of the grate casing by dot welded connections and clinch connections.

3. The container according to claim 1, comprising a triple dot welding of the vertical grate rods to the web of the border profiles of the grate casing.

* * * * *